US010517344B2

(12) United States Patent
Stark

(10) Patent No.: US 10,517,344 B2
(45) Date of Patent: Dec. 31, 2019

(54) ADJUSTABLE HAT WITH REMOVABLE ADJUSTMENT STRAPS

(71) Applicant: John Stark, Rogers, AR (US)

(72) Inventor: John Stark, Rogers, AR (US)

( * ) Notice: Subject to any disclaimer, the term of this patent is extended or adjusted under 35 U.S.C. 154(b) by 103 days.

(21) Appl. No.: 15/805,041

(22) Filed: Nov. 6, 2017

(65) Prior Publication Data

US 2019/0133231 A1 May 9, 2019

(51) Int. Cl.

| | |
|---|---|
| ***A42B 1/22*** | (2006.01) |
| ***A42B 1/06*** | (2006.01) |
| ***A42B 7/00*** | (2006.01) |

(52) U.S. Cl.

CPC ..... *A42B 1/225* (2013.01); *A42B 1/062* (2013.01); *A42B 1/22* (2013.01); *A42B 7/00* (2013.01)

(58) Field of Classification Search

CPC ..... A42B 1/225; A42B 1/22; A42B 1/006; A42B 1/062; A42B 1/061; A42B 7/00; A42B 1/065; A42B 1/06; A42B 3/147; A42B 3/145; A42B 3/142; A41F 1/00; A41F 1/008; A41F 9/00; A41F 9/002

USPC ..... 2/195.2, 195.4, 195.3

See application file for complete search history.

(56) References Cited

U.S. PATENT DOCUMENTS

| | | | | |
|---|---|---|---|---|
| 1,535,841 | A * | 4/1925 | Lupien | A42B 1/22 2/195.2 |
| 1,688,013 | A * | 10/1928 | Greenstein | A42B 1/22 2/195.2 |
| 5,402,538 | A * | 4/1995 | Conrad | A42B 1/22 2/183 |
| 5,584,076 | A | 12/1996 | Armstrong | |
| 5,657,491 | A | 8/1997 | Young | |
| 6,094,749 | A | 8/2000 | Proctor | |
| 6,446,266 | B1 | 9/2002 | Park | |
| 6,941,581 | B1 * | 9/2005 | England | A42B 1/22 2/195.2 |
| 9,161,584 | B1 * | 10/2015 | Garrett, Jr. | A42B 1/004 |
| 2002/0108165 | A1 | 8/2002 | Porter et al. | |
| 2003/0131396 | A1 * | 7/2003 | Park | A42B 1/22 2/183 |
| 2003/0233696 | A1 | 12/2003 | Lee | |
| 2004/0187191 | A1 | 9/2004 | Lee | |
| 2008/0282517 | A1 * | 11/2008 | Claro | A41F 1/002 24/303 |
| 2015/0135406 | A1 * | 5/2015 | Nguyen | A42B 1/205 2/209.12 |
| 2016/0021961 | A1 * | 1/2016 | Lacy | A42B 1/22 2/195.4 |

* cited by examiner

*Primary Examiner* — Amy Vanatta
(74) *Attorney, Agent, or Firm* — Michael L. Leetzow, P.A.

(57) ABSTRACT

An adjustable hat has a first attachment member and a strap connection member that cooperate to allow a strap to be easily connected and removed from the adjustable hat. The two elements may also be reversed with regard to construction and attachment to parts of the hat. The two members can be disengaged from one another without having to access them in the space formed by the hat and the band.

15 Claims, 7 Drawing Sheets

ADJUSTABLE HAT WITH REMOVABLE ADJUSTMENT STRAPS

BACKGROUND OF THE INVENTION

Field of the Invention

Adjustable caps, and particularly baseball caps, have been used by fans for years. Manufacturers and store owners alike appreciate the ability to adjust the size of one style of cap for many different sized heads to reduce the inventory that must be kept on hand. With adjustable sizing for the caps, more hats with different styles and decorations may be carried by the stores. There are a number of ways of making the hats adjustable. There are elastic bands that allow the user to stretch the hat for a larger head. There are hats with a strap across the back that can be adjusted at one end. There are hats with two straps that can be attached to one another at different points to change the size of the hat.

There are also hats with adjustable straps that have indicia attached thereto. This indicia may be the name of a team, a mascot or an institution. There may also be other decorations or logos that can be included on the strap/s. However, the user of the hat may wish to change the indicia that is on the straps, but this cannot be done when the straps are permanently affixed to the hats or the bands in the hats. However, the user may wish to change the indicia (or the strap itself) repeatedly without destroying the hat or having to buy more than one hat. Thus, an adjustable strap is disclosed that allows the user to change the straps quickly, efficiently and without taking the hat apart.

SUMMARY OF THE INVENTION

The present invention is directed to an adjustable hat that includes a main hat portion and a bill, the main hat portion having an inside surface, an outside surface, and an arcuate opening in the main hat portion, a band disposed around a bottom portion of the main hat portion and forming a space between the main hat portion and the band, the band and the main hat portion interrupted by the arcuate opening, the arcuate opening creating a first end and a second end of the band, a first attachment member extending between a first end and a second end and defining an axis therealong, the first attachment member attached at the first end thereof to the adjustable hat adjacent the first end of the band in the space between the main hat portion and the band, the second end of the first attachment member being a first connection member, and a strap removably attachable to the first attachment member, the strap having a strap connection member attached at a first end to engage the first connection member of the first attachment member, the first connection member and the strap connection member moving relative to one another and moving one inside at least a portion of the other along the axis to removably secure the strap to the first attachment member.

In some embodiments, there is also a second attachment member extending between a first end and a second end and defining an axis therealong, the second attachment member attached at the first end to the adjustable hat adjacent the second end of the band in the space between the main hat portion and the band, the second end of the second attachment member being a second connection member and wherein the strap has a second end having a second strap connection member, the second connection member and the second strap connection member moving relative to one another and one inside at least a portion of the other along the axis to removably secure the strap to the second attachment member.

In some other embodiments, there also is a second attachment member extending between a first end and a second end and defining an axis therealong, the second attachment member attached at the first end to the adjustable hat at the second end of the band in the space between the main hat portion and the band, the second end of the second attachment member being a second connection member, and a second strap removably attachable to the second attachment member, the second strap having a second strap connection member attached at a first end to engage the first connection member of the second attachment member, the second connection member and the second strap connection member moving relative to one another and one inside at least a portion of the other along the axis to removably secure the second strap to the second attachment member, wherein the strap and the second strap are removably attachable to one another.

According to another aspect of the present invention, there is an adjustable hat that includes a main hat portion and a bill, the main hat portion having an inside surface, an outside surface, and an arcuate opening in the main hat portion, a band disposed around a bottom portion of the main hat portion and forming a space between the main hat portion and the band, the band and the main hat portion interrupted by the arcuate opening, the arcuate opening creating a first end and a second end of the band, a first attachment member extending between a first end and a second end and defining an axis therealong, the first attachment member attached at the first end thereof to the adjustable hat adjacent the first end of the band in the space between the main hat portion and the band, the second end of the first attachment member being a first connection member, a second attachment member extending between a first end and a second end and defining an axis therealong, the second attachment member attached at the first end to the adjustable hat adjacent the second end of the band in the space between the main hat portion and the band, the second end of the second attachment member being a second connection member and wherein the strap has a second end having a second strap connection member, and a strap removably attachable to the first attachment member, the strap having a first strap connection member attached at a first end to engage the first connection member of the first attachment member and a second strap connection member attached at a second end of the strap to engage the second connection member of the second attachment member, wherein the connection members and the strap connection members moving relative to one another and moving one inside at least a portion of the other along the axis to removably secure the strap to the attachment members.

According to another aspect, an adjustable hat includes a main hat portion and a bill, the main hat portion having an inside surface, an outside surface, and an arcuate opening in the main hat portion, a band disposed around a bottom portion of the main hat portion and forming a space between the main hat portion and the band, the band and the main hat portion interrupted by the arcuate opening, the arcuate opening creating a first end and a second end of the band, a first attachment member extending between a first end and a second end and defining an axis therealong, the first attachment member attached at the first end thereof to the adjustable hat adjacent the first end of the band in the space between the main hat portion and the band, the second end of the first attachment member being a first connection member, a second attachment member extending between a first end and a second end and defining an axis therealong, the second attachment member attached at the first end to the adjustable hat at the second end of the band in the space between the main hat portion and the band, the second end of the second attachment member being a second connection member, a first strap removably attachable to the first attachment member, the first strap having a first strap connection member attached at a first end to engage the first connection member of the first attachment member, the first connection member and the first strap connection member moving relative to one another and moving one inside at least a portion of the other along the axis to removably secure the first strap to the first attachment member, and a second strap removably attachable to the second attachment member, the second strap having a second strap connection member attached at a first end to engage the first connection member of the second attachment member, the second connection member and the second strap connection member moving relative to one another and one inside at least a portion of the other along the axis to removably secure the second strap to the second attachment member, wherein the strap and the second strap are removably attachable to one another.

It is to be understood that both the foregoing general description and the following detailed description of the present embodiments of the invention are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention and, together with the description, serve to explain the principles and operations of the invention.

DETAILED DESCRIPTION OF THE PREFERRED EMBODIMENTS

Figure 1:
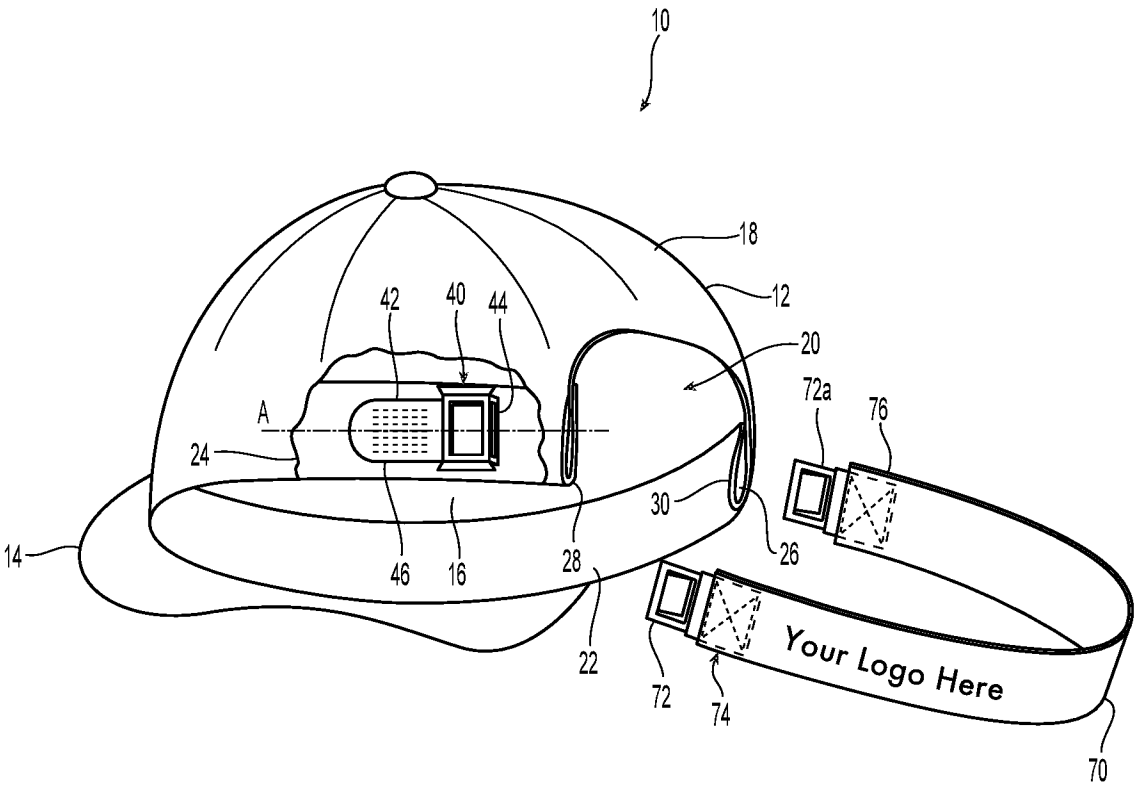
FIG. 1 is a left rear perspective view of one embodiment of an adjustable hat according to the present invention with an adjustable and removable strap.
Figure 2:
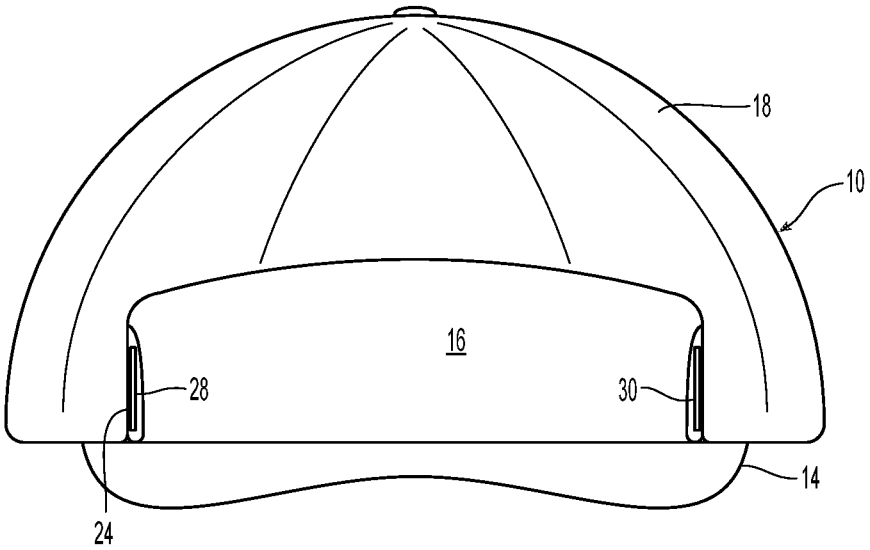
FIG. 2 is a rear elevational view of the adjustable hat of FIG. 1 without the adjustable and removable strap showing the attachment members in the hat.

Reference will now be made in detail to the present preferred embodiment(s) of the invention, examples of which are illustrated in the accompanying drawings. Whenever possible, the same reference numerals will be used throughout the drawings to refer to the same or like parts.

Referring to FIGS. 1-6, there is an adjustable hat 10, which is illustrated as a baseball cap, but could be any type of cap that needs to be adjustable. Such other hats may include snapback and dad hats. The adjustable hat 10 has a main hat portion 12, and a bill 14. The main hat portion 12 has an inside surface 16, an outside surface 18, and an arcuate opening 20 in the main hat portion 12. The adjustable hat 10 also has a band 22 disposed around a bottom portion 24 of the inside surface 16 of the main hat portion 12 and forming an opening or space 26 between the main hat portion 12 and the band 22. The band 22 and the main hat portion 12 are interrupted by the arcuate opening 20, the arcuate opening 20 creating a first end 28 and a second end 30 of the band 22. The band 22 may be a continuation of the main hat portion 12 or be a separate element attached to the main hat portion 12.

It is in the arcuate opening 20 that a strap is used to alter the size of the adjustable hat 10. The adjustable hat 10 of the present invention has a first attachment member 40 (FIG. 3) extending between a first end 42 and a second end 44 and has an axis A therealong. As illustrated in FIG. 1, the first attachment member 40 is attached at the first end 42 thereof to the adjustable hat 10 adjacent the first end 28 of the band 22 in the space 26 between the main hat portion 16 and the band 22. A second attachment member 40*a* that is identical to the first attachment member 40 is attached at the second end 30 of the band 22. See FIG. 4. The first attachment member 40 is illustrated with a tab or extension 46 attached thereto. Preferably the tab 46 is sewn to either the band 22 or the main hat portion 12 to attach the first attachment member 40 to the adjustable hat 10. The tab 46 can be attached to the first attachment member by any means, e.g., glued, sewn, welded, etc. At the second end 44 of the first attachment member 40 is a first connection member 48 that attaches to a strap as discussed in more detail below. The first connection member 48 is best seen in FIGS. 1 and 3-6. The first connection member 48 has a main body portion 50 with a cavity 52 that is accessible through opening 54 in one side 56. The opening 54 receives a corresponding connection member as discussed in more detail below. The main body portion 50 also includes a second opening 60 to receive therein a tab from the connection member. As illustrated in FIG. 1, the second opening 60 faces the main hat portion 12, but if the first connection member 48 were attached to the main hat portion 12, then it would face the band 22. The main body portion 50, in addition to having the tab 46 may also have wing portions 62 on opposite sides thereof. The wing portions 62 may be used in addition to or in the alternative to the tab 46 to secure the first attachment member to the adjustable hat 10. The tab 46 and the wing portions 62 may be made of the same material as the main body portion (plastic) or may be fabricated out of other appropriate materials such as cloth, etc.

A strap 70 is removably attachable to the first and second attachment members 40, 40*a*. The strap 70 has a strap connection member 72 attached at a first end 74 of the strap 70 to engage the first connection member 48 of the first attachment member 40. The first connection member 48 and the strap connection member 72 move relative to one another and moving one inside at least a portion of the other along the axis A to removably secure the strap 70 to the first attachment member 40. A second strap connection member 72*a* is also attached at a second end 76 of the strap 70 to engage the second attachment member 40*a* at the second end 30 of the band 22 in the same manner as the first attachment member 40*a*. See FIGS. 1 and 3.

Figure 3:
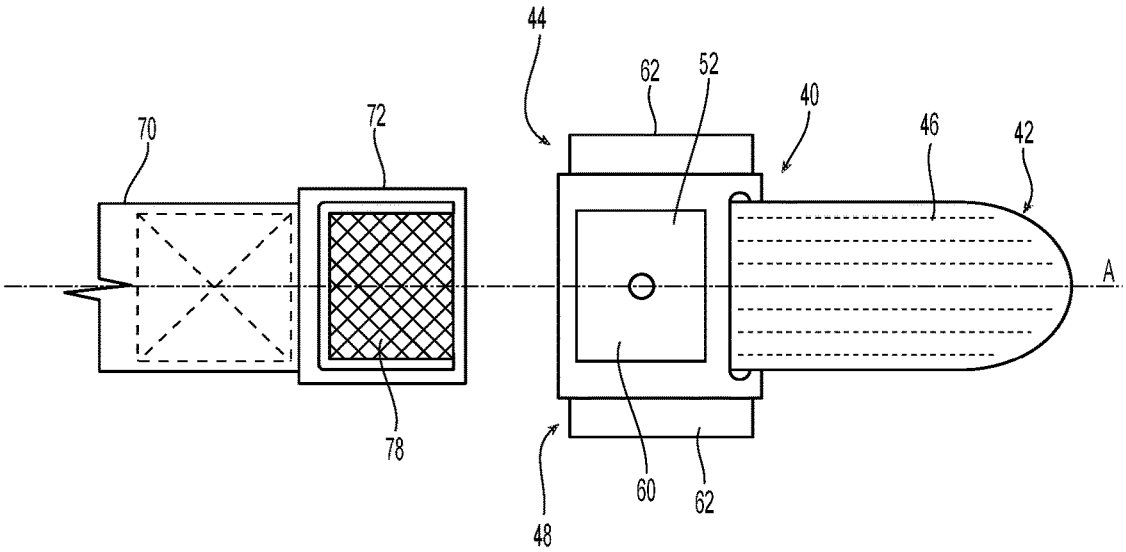
FIG. 3 is an elevational view of one embodiment of an attachment member and a connection member according to the present invention as illustrated with the adjustable hat of FIG. 1.
Figure 4:
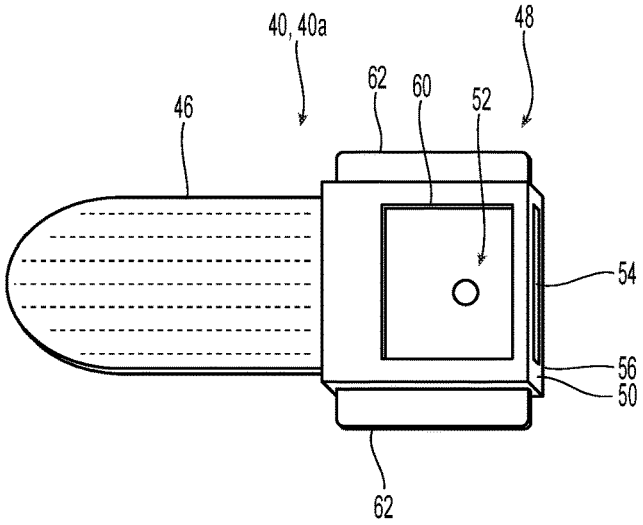
FIG. 4 is a perspective view of an attachment member in FIG. 3.
Figure 5:
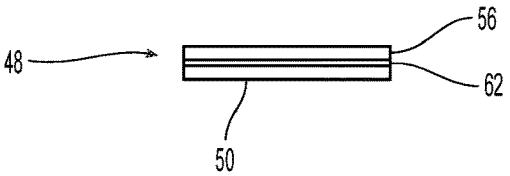
FIG. 5 is a side view of the attachment member of FIG. 4.

As can be better seen in FIG. 3, the strap connection member 72 is a first buckle portion that has a resilient tab 78 that can be pressed into the plane of the remaining portion of the strap connection member 72 so it can slide into the cavity 52 in the first connection member 48 through the opening 54 in the end 56. The first connection member 48 is a second buckle portion, the two buckle portions engaging one another to keep the strap 70 attached the adjustable hat 10. It should be noted that the two buckle portions can be reversed and that the strap connection member 52 can be secured in the adjustable hat 10 and the first attachment member 40 can be attached to the strap 70 and still fall within the scope of the present invention. As noted above, the two buckle portions (the strap connection member 72 and the first attachment member 40) move relative to one another along the axis A to engage and disengage from one another. As illustrated in FIG. 1, one of the buckle portions is inserted into the space 26 of adjustable hat 10 where the other buckle portion is secured in the space 26. The prior art hats with removable straps generally require that the two pieces are separated from one another orthogonally to the axis A—usually requiring more effort and to almost disassemble the hat to remove/change the straps. The present invention allows the user to change the strap 70 more easily by simply pressing on the strap connection member 72 from outside the adjustable hat 10. There is no need to reach into the space 26 to release the strap 70, potentially tearing or otherwise damaging the adjustable hat 10.

As illustrated in FIG. 1, the strap 70 preferably has a strap connection member 72 (could be either 48 or 72) on both ends thereof. However, there could be a strap connection member 72 on one end and a clamp or other structure to secure the second end to the adjustable hat 10.

Figure 7:
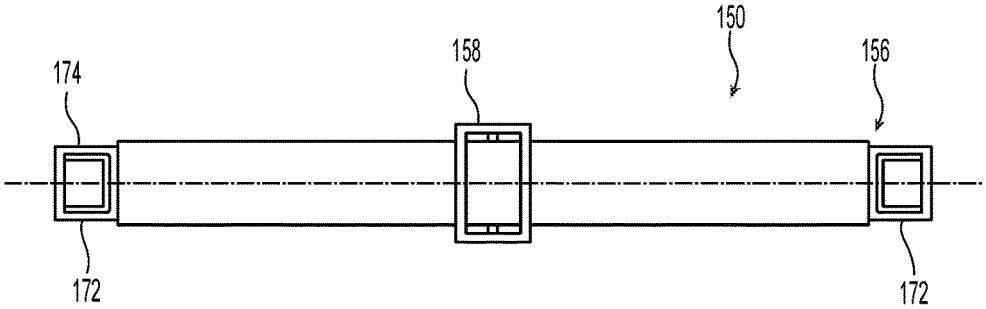
FIG. 7 is an elevational view of another embodiment of an adjustable strap with a connection member according to the present invention to be used with the adjustable hat of FIG. 1.

FIG. 7 illustrates another strap 150 that has two ends 154 and 156, each having a strap connection member 152 to connect with a corresponding attachment member (40, 40*a*) in the adjustable hat 10. There is also a buckle 158 that can be used to shorten or lengthen the strap 150 as is known in the art. The strap 150 is typically made from cloth and is the same material as the main hat portion 14.

Figure 8A:
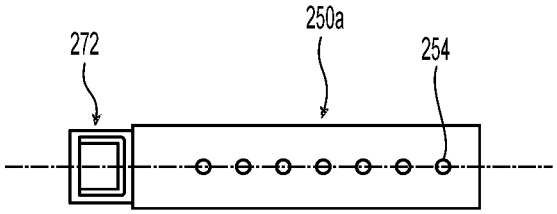
FIG. 8A is an elevational view of one embodiment of a first strap with a connection member according to the present invention to be used with the adjustable hat of FIG. 1.
Figure 8B:
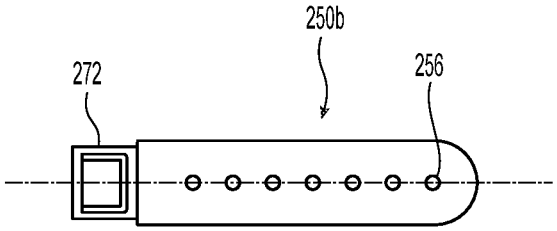
FIG. 8B is an elevational view of one embodiment of a second strap with a connection member according to the present invention to be used with the adjustable hat of FIG. 1 and the first strap in FIG. 8A.

Rather than having one strap to adjust the size of the adjustable hat 10, there could also be two straps 250*a*, 250*b* that are provided with the adjustable hat 10 to alter the size of the hat as illustrated in FIGS. 8A and 8B. The straps 250*a*, 250*b* have a strap connection members 252 that are the same as illustrated above. However, the strap 250*a* is typically a plastic piece that has a plurality of knobs 254 that extend outward from the strap 250*a*. Strap 250*b* is the corresponding strap made from plastic that has corresponding openings 256 to receive the knobs 254 from the strap 250*a*. As is known in the art, the straps 250*a*, 250*b* can be moved relative to one another and then secured with the knobs 254 and openings 256 to adjust the size of the hat. The strap connection members 252 can be attached to the straps 250*a*, 250*b* in any known and/or conventional manner.

Figure 6:
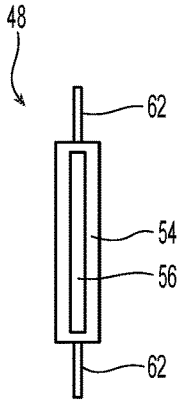
FIG. 6 is an end view of the attachment member of FIG. 4.
Figure 9:
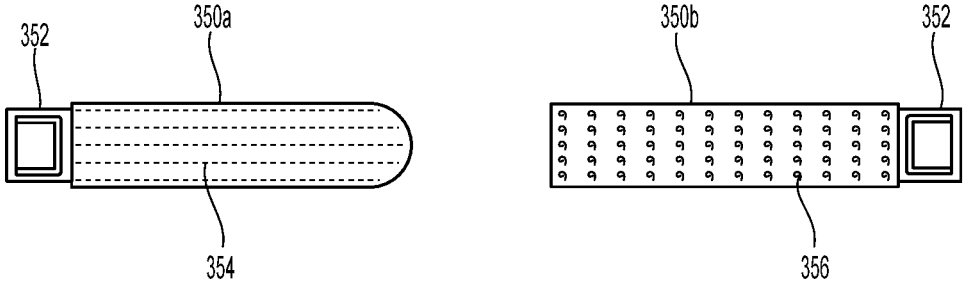
FIG. 9 is an elevational view of another embodiment of an adjustable strap having hook-and-loop with a connection member and an embodiment of an attachment member according to the present invention to be used with the adjustable hat of FIG. 1.

FIG. 9 illustrates another set of straps 350*a*, 350*b* that are provided with the adjustable hat 10 to alter the size of the hat as illustrated in FIG. 6. The straps 350*a*, 350*b* have a strap connection members 352 that are the same as illustrated above. However, the straps 350*a*, 350*b* have one of a loop-and-hook connector pair 354, 356. It does not matter to the invention which side has the hoop portion and which side has the loop portion.

Figure 10:
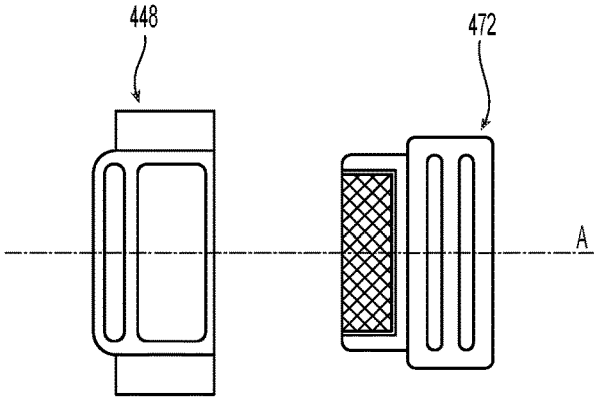
FIG. 10 is an elevational view of another embodiment of an attachment member and a connection member according to the present invention to be used with the adjustable hat of FIG. 1.

While the above straps have been illustrated with the same connector pair (the strap connection member 72 and the first attachment member 40), there are other connector pairs that can be used with single or two-piece straps. For example as illustrated in FIG. 10 is another set of buckles that could be used with the adjustable hat. In this case, the first connection member 448 is similar to first connection member 48, but is generally smaller along the axis A through the connectors. Consistent therewith, the strap connection member 472 is similarly sized, but has the same openings as noted above. Again, the two components can be exchanged as to location on the strap and main hat portion/band and still fall within the scope of the present invention.

Figure 11:
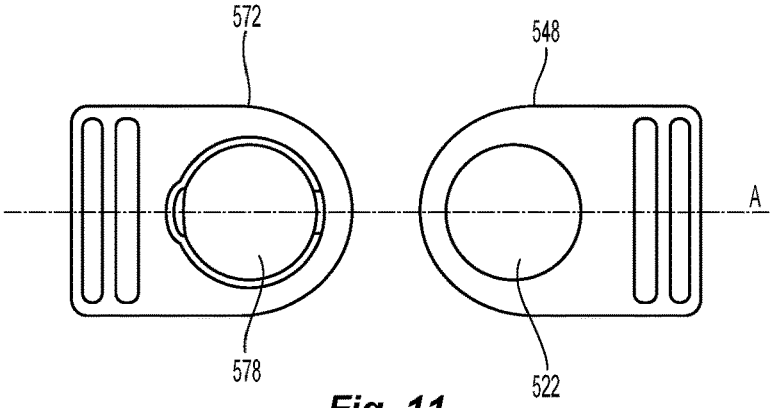
FIG. 11 is an elevational view of another embodiment of an attachment member and a connection member according to the present invention to be used with the adjustable hat of FIG. 1.

Another embodiment of a strap connection member 572 and corresponding first attachment member 548 are illustrated in FIG. 11. The operation is the same as the others noted above—there is a resilient tab 578 that engages an opening 552 when it is inserted into the first connection member 548 along the axis A. Again, the strap connection member 572 and first connection member 548 can be reversed with regard to the part of the hat to which they are attached.

Figure 12:
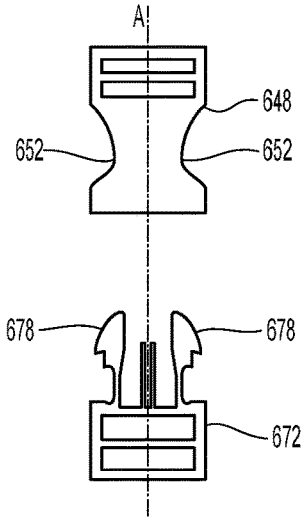
FIG. 12 an elevational view of another embodiment of an attachment member and a connection member according to the present invention to be used with the adjustable hat of FIG. 1.
Figure 13:
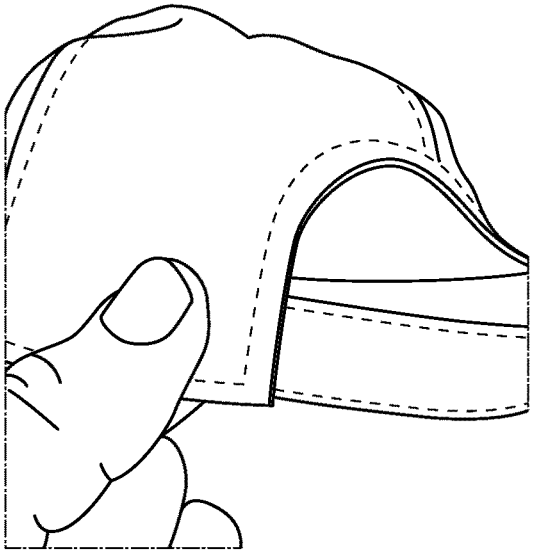
FIG. 13 is a left rear perspective view of one embodiment of an adjustable hat showing how to release the connection member from the attachment member for certain ones of the adjustable strap.
Figure 14:
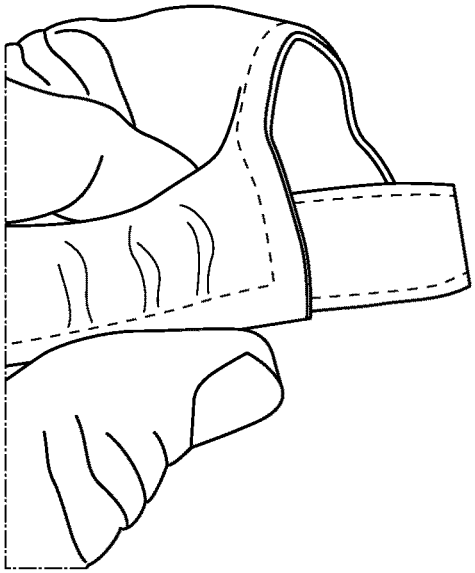
FIG. 14 is a left rear perspective view of one embodiment of an adjustable hat showing how to release the connection member from the attachment member for certain other ones of the adjustable strap.

Another embodiment of a strap connection member 672 and corresponding first attachment member 648 are illustrated in FIG. 12. The operation is the same as the others noted above—except that there are two resilient tabs 678 that engage one of two openings 652 when strap connection member 672 is inserted into the first connection member 648 along the axis A. Again, the strap connection member 572 and first connection member 548 can be reversed with regard to the part of the hat to which they are attached.

In conjunction with FIG. 11, the owner of the adjustable hat 10 can remove one of the straps be simply squeezing the adjustable hat 10 where the resilient tabs are located. Simply squeezing the hat with two fingers and simultaneously pulling on the strap will cause the strap to be freed and pulled from the space 26. There is no need to access the first attachment member in the space or to even see where the components are located. With regard to the components illustrated in FIG. 10 and as illustrated in FIG. 12, the user can again squeeze the resilient tabs on either side and pull the strap out of the space 26. Thus, one finger can be on the top and another (or the thumb) can be underneath the cap—by the junction of the main hat portion and the band to squeeze the resilient tabs and allow the strap to be pulled out.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

I claim:

1. An adjustable hat comprising:

a main hat portion and a bill, the main hat portion having an inside surface, an outside surface, and an arcuate opening in the main hat portion;

a band disposed around a bottom portion of the main hat portion and forming a space between the main hat portion and the band, the band and the main hat portion interrupted by the arcuate opening, the arcuate opening creating a first end and a second end of the band; a first attachment member extending between a first end and a second end and defining an axis therealong, the first attachment member attached at the first end thereof to the adjustable hat adjacent the first end of the band in the space between the main hat portion and the band, the second end of the first attachment member being a first connection member; and a strap removably attachable to the first attachment member, the strap having a strap connection member attached at a first end to engage the first connection member of the first attachment member, the first connection member and the strap connection member moving relative to one another and moving one inside at least a portion of the other along the axis to removably secure the strap to the first attachment member.

2. The adjustable hat according to claim 1, further comprising a second attachment member extending between a first end and a second end and defining an axis therealong, the second attachment member attached at the first end to the adjustable hat adjacent the second end of the band in the space between the main hat portion and the band, the second end of the second attachment member being a second connection member and wherein the strap has a second end having a second strap connection member, the second connection member and the second strap connection member moving relative to one another and one inside at least a portion of the other along the axis to removably secure the strap to the second attachment member.

3. The adjustable hat according to claim 1, further comprising:

a second attachment member extending between a first end and a second end and defining an axis therealong, the second attachment member attached at the first end to the adjustable hat at the second end of the band in the space between the main hat portion and the band, the second end of the second attachment member being a second connection member; and a second strap removably attachable to the second attachment member, the second strap having a second strap connection member attached at a first end to engage the second connection member of the second attachment member, the second connection member and the second strap connection member moving relative to one another and one inside at least a portion of the other along the axis to removably secure the second strap to the second attachment member, wherein the strap and the second strap are removably attachable to one another.

4. The adjustable hat according to claim 1, wherein one of the first connection member and the strap connection member comprises a first buckle portion and the other of the first connection member and the strap connection member comprises a second buckle portion, the first buckle portion having a resilient tab and second buckle portion having a first opening to receive the first buckle portion and a second opening to receive the resilient tab.

5. The adjustable hat according to claim 3, wherein one of the second connection member and the second strap connection member comprises a first buckle portion and the other of the second connection member and the second strap connection member comprises a second buckle portion, the first buckle portion having a resilient tab and second buckle portion having a first opening to receive the first buckle portion and a second opening to receive the resilient tab.

6. The adjustable hat according to claim 4, wherein the second opening faces one of the band and the main hat portion.

7. The adjustable hat according to claim 5, wherein the second opening faces one of the band and the main hat portion.

8. The adjustable hat according to claim 4, wherein the first opening and the second opening are on adjacent sides of the second buckle portion.

9. The adjustable hat according to claim 3, wherein the strap has a plurality of through holes and the second strap has a plurality of projections, the through holes in the strap to receive the projections from the second strap to fix the strap and second strap in a fixed relationship.

10. The adjustable hat according to claim 3, wherein the first strap has a hook portion of a hook-and-loop connector and the second strap has a loop portion of a hook-and-loop connector fix the first strap and second strap in a fixed relationship.

11. An adjustable hat comprising:

a main hat portion and a bill, the main hat portion having an inside surface, an outside surface, and an arcuate opening in the main hat portion;

a band disposed around a bottom portion of the main hat portion and forming a space between the main hat portion and the band, the band and the main hat portion interrupted by the arcuate opening, the arcuate opening creating a first end and a second end of the band; a first attachment member extending between a first end and a second end and defining an axis therealong, the first attachment member attached at the first end thereof to the adjustable hat adjacent the first end of the band in the space between the main hat portion and the band, the second end of the first attachment member being a first connection member;

a second attachment member extending between a first end and a second end and defining an axis therealong, the second attachment member attached at the first end to the adjustable hat adjacent the second end of the band in the space between the main hat portion and the band, the second end of the second attachment member being a second connection member; and a strap removably attachable to the first attachment member, the strap having a first strap connection member attached at a first end to engage the first connection member of the first attachment member and a second strap connection member attached at a second end of the strap to engage the second connection member of the second attachment member, wherein the connection members and the strap connection members moving relative to one another and moving one inside at least a portion of the other along the axis to removably secure the strap to the attachment members.

12. An adjustable hat comprising:

a main hat portion and a bill, the main hat portion having an inside surface, an outside surface, and an arcuate opening in the main hat portion;

a band disposed around a bottom portion of the main hat portion and forming a space between the main hat portion and the band, the band and the main hat portion interrupted by the arcuate opening, the arcuate opening creating a first end and a second end of the band; a first attachment member extending between a first end and a second end and defining an axis therealong, the first attachment member attached at the first end thereof to the adjustable hat adjacent the first end of the band in the space between the main hat portion and the band, the second end of the first attachment member being a first connection member;

a second attachment member extending between a first end and a second end and defining an axis therealong, the second attachment member attached at the first end to the adjustable hat at the second end of the band in the space between the main hat portion and the band, the second end of the second attachment member being a second connection member;

a first strap removably attachable to the first attachment member, the first strap having a first strap connection member attached at a first end to engage the first connection member of the first attachment member, the first connection member and the first strap connection member moving relative to one another and moving one inside at least a portion of the other along the axis to removably secure the first strap to the first attachment member, and a second strap removably attachable to the second attachment member, the second strap having a second strap connection member attached at a first end to engage the second connection member of the second attachment member, the second connection member and the second strap connection member moving relative to one another and one inside at least a portion of the other along the axis to removably secure the second strap to the second attachment member, wherein the first strap and the second strap are removably attachable to one another.

13. The adjustable hat according to claim 12, wherein the first strap has a plurality of through holes and the second strap has a plurality of projections, the through holes in the first strap to receive the projections from the second strap to fix the first strap and second strap in a fixed relationship.

14. The adjustable hat according to claim 12, wherein the first strap has a hook portion of a hook-and-loop connector and the second strap has a loop portion of a hook-and-loop connector fix the first strap and second strap in a fixed relationship.

15. The adjustable hat according to claim 12, wherein one of the first connection member and the first strap connection member comprises a first buckle portion and the other of the first connection member and the first strap connection member comprises a second buckle portion, the first buckle portion having a resilient tab and second buckle portion having a first opening to receive the first buckle portion and a second opening to receive the resilient tab and one of the second connection member and the second strap connection member comprises a first buckle portion and the other of the second connection member and the second strap connection member comprises a second buckle portion, the first buckle portion having a resilient tab and second buckle portion having a first opening to receive the first buckle portion and a second opening to receive the resilient tab.

* * * * *